US007766101B2

(12) United States Patent
Clark

(10) Patent No.: US 7,766,101 B2
(45) Date of Patent: Aug. 3, 2010

(54) SYSTEM AND METHOD FOR MAKING DRILLING PARAMETER AND OR FORMATION EVALUATION MEASUREMENTS DURING CASING DRILLING

(75) Inventor: Brian Clark, Sugar Land, TX (US)

(73) Assignee: Schlumberger Technology Corporation

( * ) Notice: Subject to any disclaimer, the term of this patent is extended or adjusted under 35 U.S.C. 154(b) by 405 days.

(21) Appl. No.: 11/767,744

(22) Filed: Jun. 25, 2007

(65) Prior Publication Data

US 2008/0314585 A1 Dec. 25, 2008

(51) Int. Cl.
*E21B 10/64* (2006.01)

(52) U.S. Cl. ..... 175/257; 175/325.1

(58) Field of Classification Search ..... 175/22, 175/23, 50, 257, 325.1
See application file for complete search history.

(56) References Cited

U.S. PATENT DOCUMENTS

| | | | | |
|---|---|---|---|---|
| 6,269,893 | B1 | 8/2001 | Beaton et al. | |
| 6,705,413 | B1 | 3/2004 | Tessari | |
| 7,004,263 | B2 | 2/2006 | Moriarty et al. | |
| 7,334,650 | B2 | 2/2008 | Giroux et al. | |
| 2004/0108108 | A1 * | 6/2004 | Bailey et al. | 166/242.6 |
| 2004/0149434 | A1 * | 8/2004 | Frey et al. | 166/250.1 |
| 2004/0256157 | A1 * | 12/2004 | Tessari et al. | 175/57 |
| 2005/0274547 | A1 | 12/2005 | Fincher et al. | |
| 2006/0196695 | A1 | 9/2006 | Giroux et al. | |
| 2008/0110673 | A1 * | 5/2008 | Giroux et al. | 175/5 |

FOREIGN PATENT DOCUMENTS

| | | |
|---|---|---|
| WO | 2005061837 | 7/2005 |

* cited by examiner

*Primary Examiner*—Daniel P Stephenson
(74) *Attorney, Agent, or Firm*—David J. Smith; Dave R. Hofman

(57) ABSTRACT

A casing drilling system includes a casing having a drill bit at one end. The drill bit is capable of drilling subsurface formations and formed from a material removable by drilling or chemical exposure. The chemical is substantially harmless to the casing. The system includes a centralizer affixed to an interior of the casing. The centralizer includes a receptacle therein for engaging a measurement while drilling tool. The centralizer is formed from a material removable by drilling or chemical exposure, wherein the chemical is substantially harmless to the casing. The system includes a measurement while drilling tool configured to move along the interior of the casing and to engage with the centralizer. The tool includes a device to measure a drilling parameter or a formation parameter. The tool including a latch at an upper end thereof for engagement with a retrieval tool moved through the interior of the casing.

16 Claims, 5 Drawing Sheets

SYSTEM AND METHOD FOR MAKING DRILLING PARAMETER AND OR FORMATION EVALUATION MEASUREMENTS DURING CASING DRILLING

BACKGROUND OF THE INVENTION

1. Field of the Invention

The invention relates generally to the field of apparatus and methods for measuring drilling parameters and/or formation parameters during wellbore drilling. More particularly, the invention relates to structures and techniques for making such measurements in drilling operations known as "casing drilling."

2. Background Art

Wellbores are drilled into the Earth's subsurface to recover hydrocarbons and other desirable materials trapped in geological formations in the subsurface. A wellbore is typically drilled by advancing a drill bit through the subsurface formations. The drill bit is attached to the lower end of a "drill string" suspended from a drilling rig. The drill string is a long string of sections of drill pipe that are connected together end-to-end to form a long shaft for driving the drill bit further into the subsurface. A bottom hole assembly ("BHA") containing various instrumentation and/or devices to control the mechanical properties of the drill string is typically provided above the drill bit. Drilling fluid, or "mud", is typically pumped down through the drill string to the drill bit. The drilling fluid lubricates and cools the drill bit, and it carries drill cuttings back to the surface in the annulus between the drill string and the wellbore wall.

In conventional drilling, a well is drilled to a selected depth, and then the wellbore is typically lined with a larger-diameter pipe, usually called "casing." Casing typically consists of casing sections connected end-to-end, similar to the way drill pipe is connected. To accomplish this, the drill string and the drill bit are removed from the borehole in a process called "tripping." Once the drill string and bit are removed, the casing is lowered into the well and cemented in place. The casing protects the wellbore wall from collapse and isolates the subterranean formations from each other. After the casing is in place, drilling may continue by lowering a drill bit through the casing and continuing to drill once the drill bit reaches the bottom of the well.

Conventional drilling typically includes a series of drilling, tripping (removing the drill string from the wellbore), cementing in place a pipe or casing to protect the drilled wellbore, and then resuming drilling using a smaller diameter drill bit to extend the wellbore. The foregoing process is very time consuming and costly. Additionally, other problems may be encountered when tripping the drill string. For example, the drill string may get caught up in the borehole while it is being removed. These problems require additional time and expense to correct.

The term "casing drilling" refers to the use of a casing string in place of a drill string. Like drill string, a string of casing sections are connected end-to-end to form a casing string. The BHA and the drill bit are connected to the lower end of a casing string, and the well is drilled using the casing string to transmit drilling fluid, as well as axial and rotational forces, to the drill bit. Upon completion of drilling, the casing string may then be cemented in place to from the casing for the wellbore. Casing drilling enables the well to be simultaneously drilled and cased, thus eliminating one of the tripping steps necessary in conventional drilling.

One technique for casing drilling is described in U.S. Pat. No. 7,004,263 issued to Moriarty, et al., and assigned to the assignee of the present invention. Another casing drilling technique is described in U.S. Pat. No. 6,705,413 issued to Tessari which includes a retrievable drill bit mounted at an end of the casing string and either a mud motor with a bent housing and/or bent sub or a rotary steerable tool used to direct the bit to drill directionally.

The foregoing techniques require expensive, difficult to operate drill bits that can be retrieved through the casing after the intended wellbore depth is reached in order to provide any form of measurement or directional control, such as using measurement while drilling ("MWD") and logging while drilling ("LWD") devices. Such bits must drill a larger diameter hole than the casing, and then be reduced in diameter so that the BHA can be retrieved to the surface through the casing after the intended wellbore depth is reached.

What is needed is a system to enable casing drilling that can eliminate the need for drilling components that are retrievable through the casing.

SUMMARY OF THE INVENTION

A casing drilling system according to one aspect of the invention includes a casing having a drill bit at one end. The drill bit is capable of drilling subsurface Earth formations and is formed from a material susceptible to removal from the casing by at least one of drilling with another well drilling bit and chemical exposure. The chemical exposure is substantially harmless to the casing. The system includes at least one centralizer affixed to an interior of the casing. The at least one centralizer includes a receptacle therein for engaging a measurement while drilling tool. The at least one centralizer is formed from a material susceptible to removal from the casing by at least one of drilling with another well drilling bit and chemical exposure, wherein the chemical exposure is substantially harmless to the casing. The system includes a measurement while drilling tool configured to move along the interior of the casing and to engage with the at least one centralizer. The measurement while drilling tool includes at least one device to measure a drilling parameter or a formation parameter. The measurement while drilling tool includes a latch at an upper end thereof for engagement with a retrieval tool moved through the interior of the casing.

A method for casing drilling according to another aspect of the invention includes rotating a casing having a drill bit at one end in a wellbore while urging the casing longitudinally along the wellbore. The drill bit is capable of drilling subsurface Earth formations and is formed from a material susceptible to removal from the casing by at least one of drilling with another well drilling it and chemical exposure. The chemical exposure is substantially harmless to the casing. The casing includes therein at least one centralizer affixed to an interior of the casing. The at least one centralizer includes a receptacle therein for engaging a measurement while drilling tool. The centralizer is formed from a material susceptible to removal from the casing by at least one of drilling with another well drilling bit and chemical exposure. The chemical exposure is substantially harmless to the casing. The casing also include a measurement while drilling tool configured to move along the interior of the casing and to engage with the at least one centralizer. The measurement while drilling tool includes at least one device to measure a drilling parameter or a formation parameter. The measurement while drilling tool includes a latch at an upper end thereof for engagement with a retrieval tool moved through the interior of the casing. At a selected depth, the rotating and longitudinally urging the casing is stopped. A retrieval tool is then inserted inside the casing. The retrieval tool is engaged to the upper end of the measurement while drilling tool and the measurement while drilling tool is removed from the casing. The centralizer and the drill bit are then removed from the casing by a least one of drilling out and chemically exposing.

Other aspects and advantages of the invention will be apparent from the following description and the appended claims.

DETAILED DESCRIPTION

Figure 1:
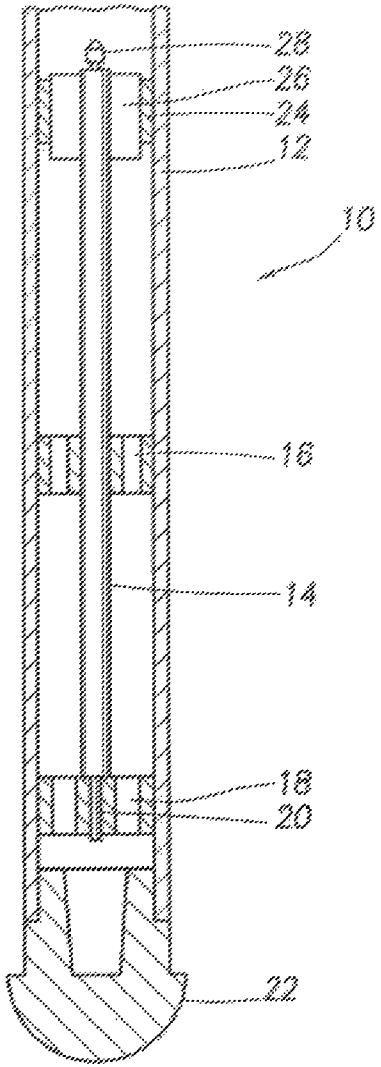
FIG. 1 shows a cross section of one example LWD/MWD casing drilling system according to the invention.

One example of a casing drilling system including a measurement while drilling ("MWD") and/or logging while drilling ("LWD") tool 14 is shown in cross section in FIG. 1. The tool 14 may be disposed inside one or more "joints" (individual segments) of casing 12. The casing 12 may be any type known in the art, and typically has threaded ends (not shown in FIG. 1) to enable threaded coupling of one joint to the next to make up a casing string. The casing 12 may be made from materials ordinarily used for wellbore casing, including carbon steel. In some examples, the casing 12 may be made from non-magnetic alloy such as monel, or an alloy sold under the trademark INCONEL, which is a registered trademark of Huntington Alloys Corporation, Huntington, W. Va. Using non-magnetic material for the casing 12 may enable using magnetic directional sensing devices in the MWD and/or LWD tool 14 (described in more detail below).

The casing 12 includes a drill bit 22 disposed at the lower end. The drill bit 22 includes cutting elements of types known in the art to drill through subsurface formations as the drill bit 22 is rotated by the casing 12 and is urged axially into the formations by transfer of some of the weight of the casing string. Such procedure is described, for example in U.S. Pat. No. 7,004,263 issued to Moriarty, et al., and assigned to the assignee of the present invention. In the present example, the drill bit 22 may be made from a material that is readily drilled with an ordinary well drilling bit to enable its removal from the bottom of the casing 12 when a selected wellbore depth is reached. Alternatively, the drill bit 22 may be made from a material that can be removed chemically or by any other method or technique that will not harm the casing 12 or the drilled Earth formation.

Figure 8:
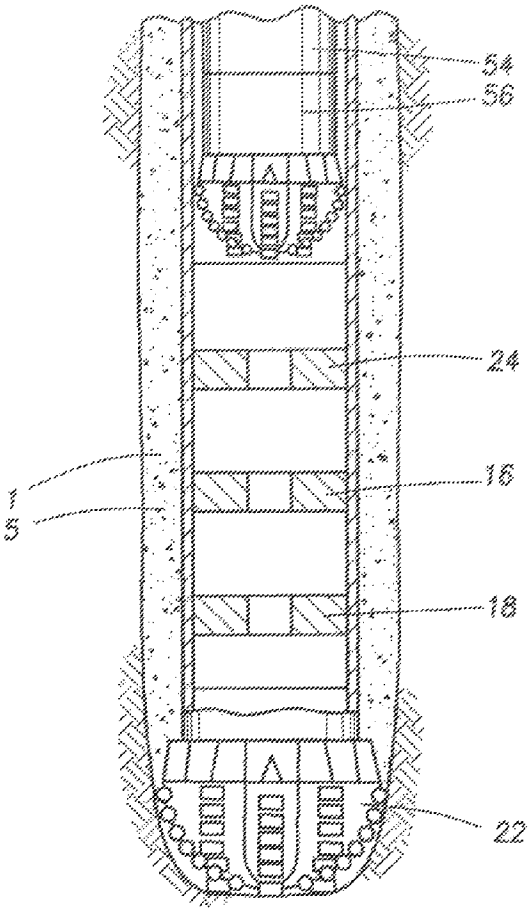
FIGS. 7 and 8 show a method for using the system shown in FIG. 1 during drilling a wellbore.
Figure 7:
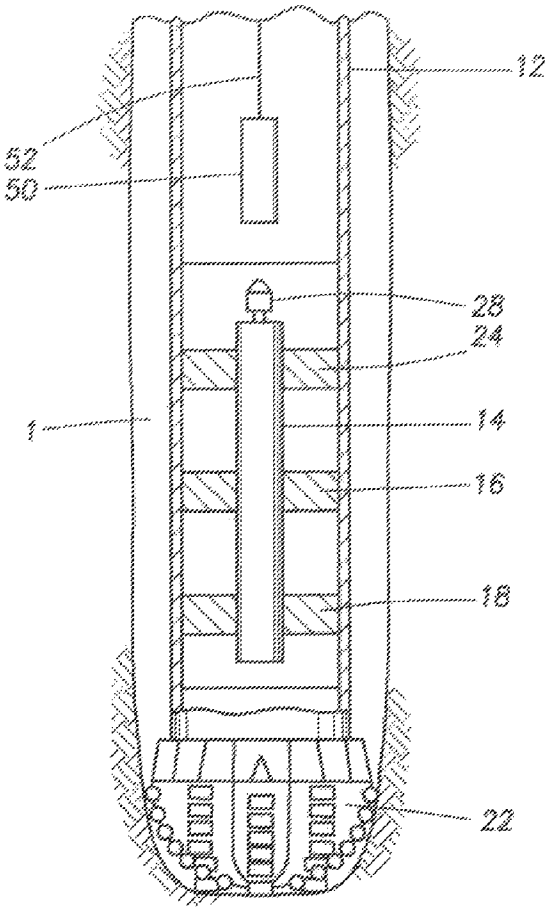

A MWD and/or LWD tool 14 (referred to as "MWD tool" hereinafter for convenience but intended to cover both types of instruments or tools) is disposed inside the casing 12. The MWD tool 14 may include one or more sensors (not shown separately) of any type known in the art for determining geometric trajectory of the casing 12 at the location of the MWD tool 14, and/or one or more sensors not shown separately) for measuring petrophysical parameters of the wellbore or the formations surrounding the wellbore (FIGS. 7 and 8). The MWD tool 14 may have a relatively narrow external diameter selected to enable retaining the MWD tool 14 generally in the center of the casing 12 while enabling relatively unimpeded flow of drilling fluid ("mud") through the interior of the casing 12. The MWD tool 14 may be retained in its longitudinal position inside the casing 12 by including inside the casing 12 one or more centralizers. In the present example, a lower centralizer 18 is disposed generally proximate to the drill bit 22 at the lower end of the casing 12. The lower centralizer 18 may include features (described below with reference to FIGS. 3A and 3B) to fix the rotary orientation of the MWD tool 14 inside the casing 12 as well as to limit the axial motion of the MWD tool 14 inside the casing 12. One or more middle centralizers 16 may be included in some examples to reduce the possibility of damage to the MWD tool 14 by flexing and associated vibration during drilling operations. The middle centralizer(s) 16 will be described in more detail with reference to FIGS. 2A and 2B. An upper centralizer 24 may be disposed near the upper end of the MWD tool 14 and may include features (to be described in more detail with reference to FIG. 4) for diverting mud flow through a flow modulator 26. The flow modulator 26 may be used in some examples to transmit some of the measurements made by the MWD tool 14 to the Earth's surface by modulating the flow of drilling fluid through the interior of the casing 12. This is known in the art as "mud-pulse telemetry." The MWD tool 14 may include a fishing neck 28 or similar feature to enable ready retrieval of the MWD tool 14 from the interior of the casing 12 when the selected wellbore depth is reached. The fishing neck 28 includes features (not shown separately) of types well known in the art for engagement of a suitable retrieval tool (not shown) disposed on the end of a wireline, slickline, coiled tubing or pipe string.

Figure 2A:
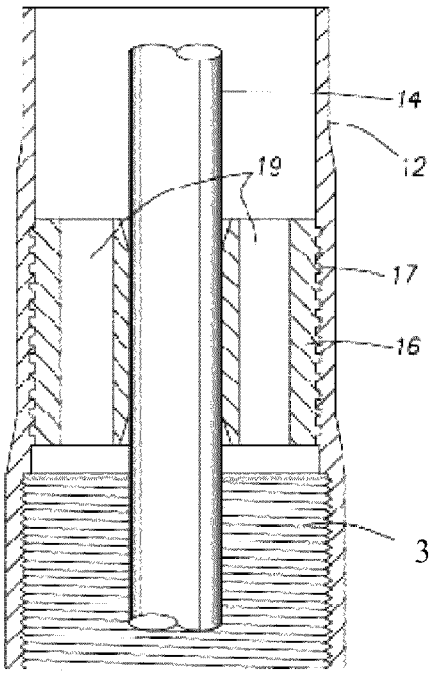
FIG. 2A shows a cross section of one example centralizer used in the system shown in FIG. 1.

One example of the one or more middle centralizers 16 is shown in cross section in FIG. 2A. The centralizer 16 may be made from aluminum, glass fiber reinforced plastic, or other material that can be readily removed by drilling or other treatment (similar to the drill bit 22) after the wellbore has reached the selected depth and the MWD tool 14 is removed from inside the casing 12. The middle centralizer 16 may be generally cylindrically shaped, having an external diameter selected to be retained inside the casing 12 by threads 17, for example, formed on the inner wall of the casing 12 or by interference fit within the casing 12. A central passage inside the centralizer 16 has a diameter selected to enable the MWD tool 14 to move longitudinally therethrough but to substantially prevent lateral movement of the MWD tool 14 in the centralizer 16. The centralizer 16 includes one or more mud passages 19 in the annular space between the MWD too 14 and the casing 12 to enable free flow of drilling mud during drilling operations. The middle centralizer 16 is shown disposed proximate a box connection 3 (female threaded coupling) that can be used to threadedly engage mating threads on the casing 12 (threads 17 may be recessed in some embodiments).

Figure 2B:
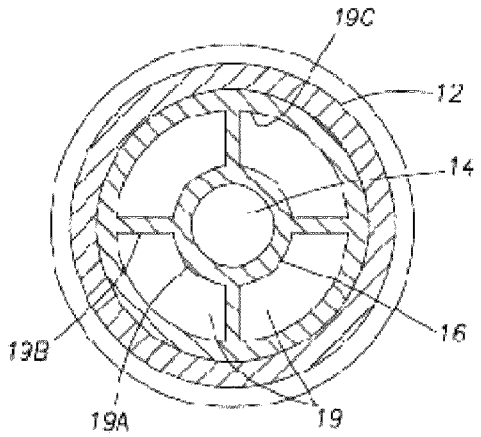
FIG. 2B is a top view of the example centralizer shown in FIG. 2B.

FIG. 2B shows an end view of the centralizer 16 of FIG. 2A. The mud passages 19 may be formed by having the central passage for the MWD tool 14 to be within a center ring 19A formed from the material used to make the centralizer 16. The center ring 19A may be disposed inside an outer ring 19C by ribs 19B extending from the center ring 19A to the outer ring 19C. The outer ring 19C may be threadedly or frictionally retained in position inside the casing 12. The mud passages 19 result from the unfilled space between the ribs 19B. The centralizer 16 may be machined, molded or cast from a single component into the form shown in FIGS. 2A and 2B, thus minimizing the manufacturing cost.

Figure 3B:
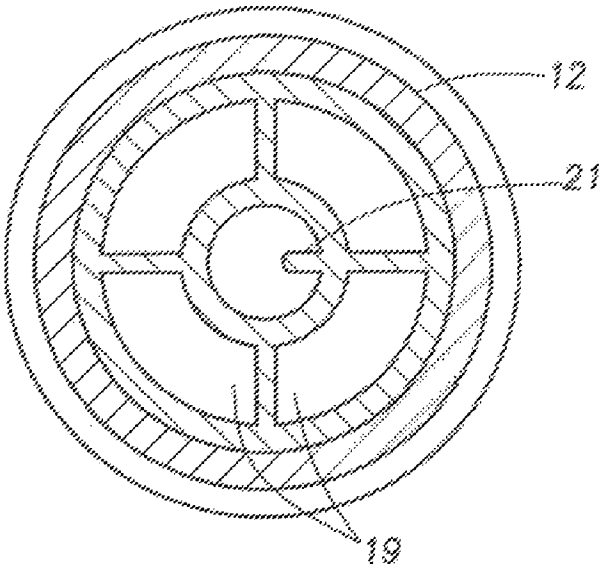
FIG. 3B is an end view of the example centralizer shown in FIG. 3A.
Figure 3A:
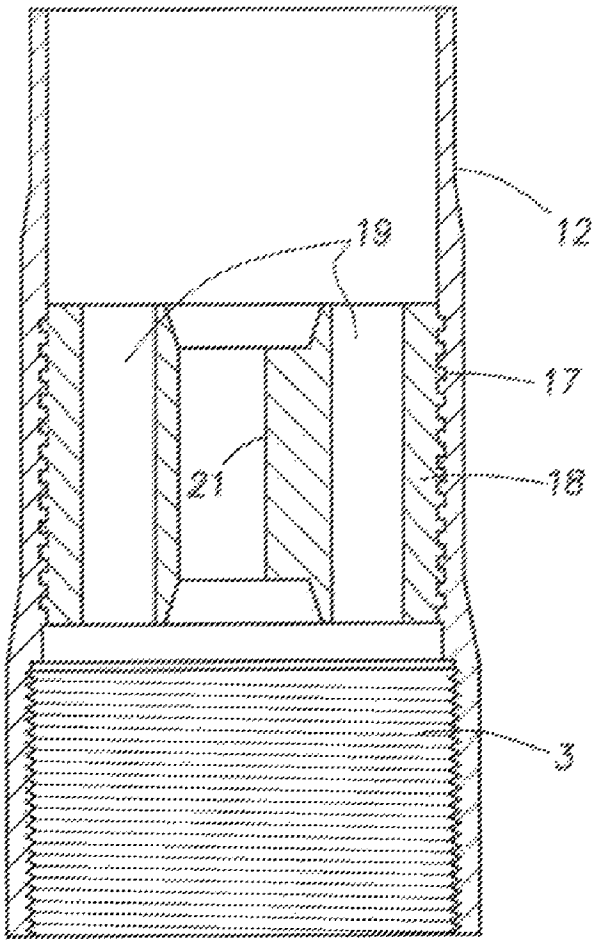
FIG. 3A shows a cross section of one example of a centralizer used to longitudinally fix position of and rotationally orient a MWD and/or LWD probe used in the system of FIG. 1.

One example of the lower centralizer 18 is shown in cross section in FIG. 3A and in end view in FIG. 3B. The lower centralizer 18 can be substantially similar in material and in structure to the one or more middle centralizers explained above with reference to FIGS. 2A and 2B. The lower centralizer 18 preferably includes a key 21 or similar feature disposed in the central passage such that when engaged with a mating feature (not shown in FIGS. 3A and 3B) on the exterior of the MWD tool (14 in FIG. 1), the longitudinal position of the MWD tool will be fixed, and the rotational orientation of the MWD tool with respect to the casing (12 in FIG. 1) will be fixed and known. Thus it will be possible to make measurements related to the geometric trajectory of the casing and the wellbore, using techniques well known in the art. The lower centralizer 18 in FIG. 3A is shown disposed proximate a box connection 3 (female threaded coupling) that can be used to threadedly engage mating threads on the drill bit (22 in FIG. 1).

Figure 4:
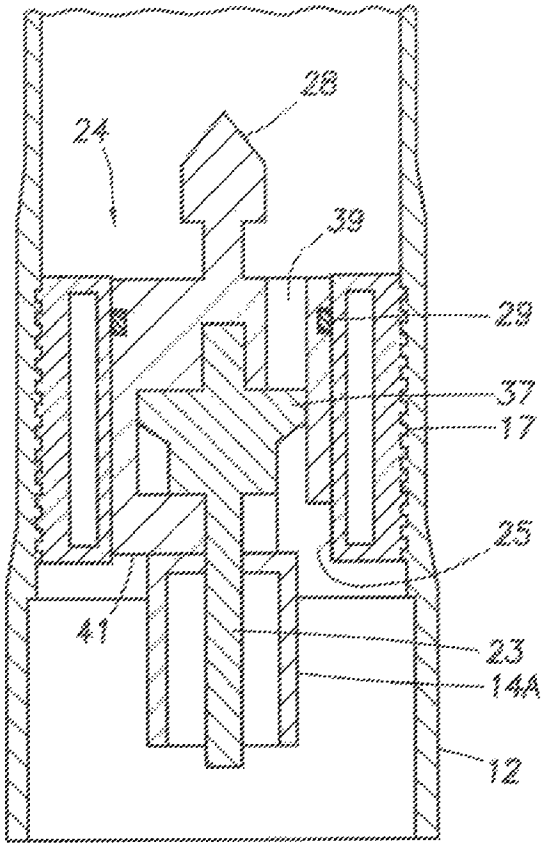
FIG. 4 shows a cross section of one example of a telemetry modulator used in the system shown in FIG. 1.

One example of an upper centralizer 24 is shown in FIG. 4. The upper centralizer 24 may be made from similar materials and have similar features to retain it in the casing 12 such as threads 17 or by interference fit as were described above with reference to the middle centralizer(s) (16 in FIGS. 2A and 2B). A central opening 25 in the upper centralizer 24 should be of a diameter and surface finish to enable sealing engagement with a modulator housing 41 disposed and surface finish to enable sealing engagement with a modulator housing 41 disposed at the upper end of the MWD tool housing 14A. A modulator operating shaft 23 extends from the upper end of the MWD tool housing 14A and enters the modulator housing 41, whereupon it moves a modulator 37. The modulator 37 cooperates with a flow passage 39 in the modulator housing 41 such that motion of the modulator 37 changes the effective cross section to flow of the passage 39. Such change can be effected by longitudinal motion or rotation of the modulator 37 to cause pressure changes in the flowing drilling fluid. The pressure changes can be any type known in the art, including pressure increase, pressure decrease or "mud siren" type modulation. The modulation is used to transmit data from the MWD tool (14 in FIG. 1) to the Earth's surface, where the modulation may be detected. The modulator housing 41 may be sealed to the central opening 25 using an o-ring 29 or similar annular sealing device. The fishing neck 28 is shown in the upper portion of the modulator housing 41.

Figure 5B:
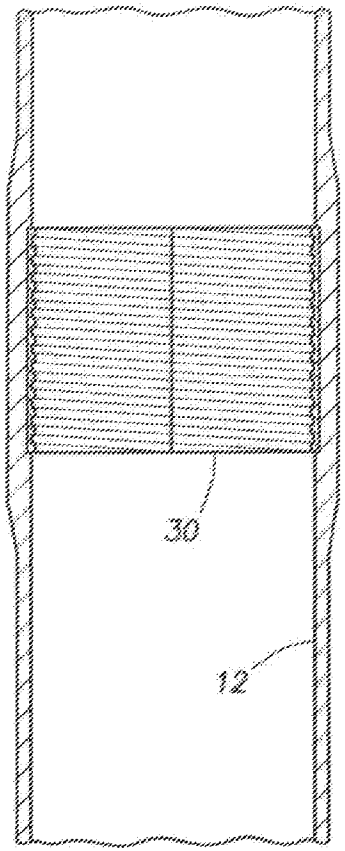
FIG. 5B shows the insert of FIG. 5A without a centralizer engaged therein.
Figure 5A:
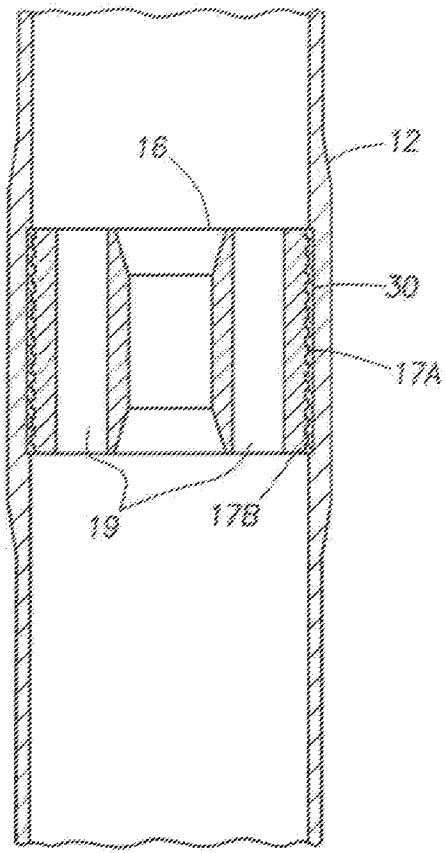
FIG. 5A shows one example of a threaded insert mounted inside a casing joint used to threadedly retain a centralizer.

Referring to FIG. 5A, in some examples, the centralizer (middle centralizer 16 shown in FIG. 5A) can be retained inside the casing 12 by providing a threaded insert 30 at the selected longitudinal position of the centralizer 16 inside the casing 12. The threaded insert may be frictionally retained, adhesively bonded or welded inside the casing 12, or may be retained therein by any other retention device known in the art. The threaded insert 30 preferably includes threads 17A on its interior surface shaped to engage mating threads 17B on the exterior of the centralizer 16. The configuration shown in FIG. 5A may be used for any or all of the lower centralizer (18 of FIG. 1) the one or more middle centralizers (16 in FIG. 1) or the upper centralizer (24 in FIG. 1). FIG. 5B shows the insert 30 without the centralizer in place therein.

In some examples, the one or more middle centralizers (16 in FIG. 1) and the upper centralizer (24 in FIG. 1) may be affixed to the exterior of the MWD tool (14 in FIG. 1) such that the one or more middle and upper centralizers are inserted into the casing (12 in FIG. 1) with the MWD tool when the MWD tool is inserted therein. Correspondingly, such centralizers are removed from the casing with the MWD tool when the MWD tool is removed. One example of such removal will be explained in more detail below with reference to FIGS. 7 and 8. In such examples, the one or more middle and upper centralizers may not be made from a drillable or otherwise readily removable material.

Figure 6:
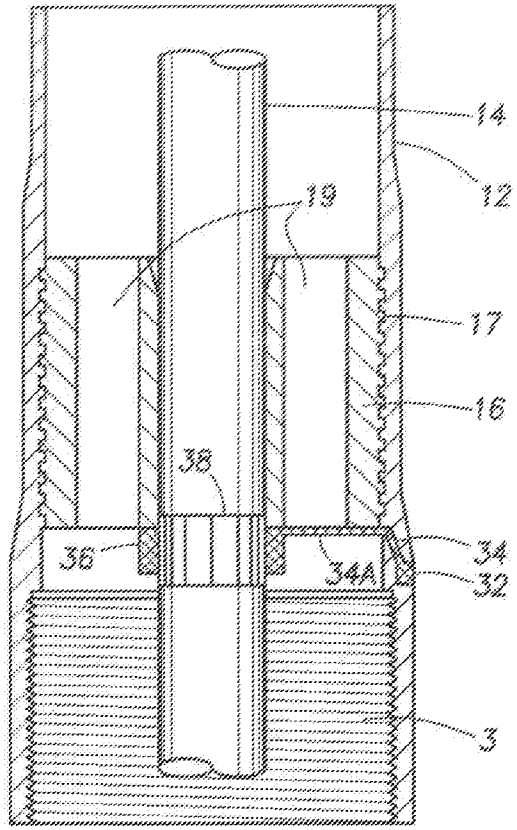
FIG. 6 shows one example of a centralizer used in the system of FIG. 1 having a pressure sensor arranged to measure pressure in the annular space in a wellbore outside the casing.

In some applications of an MWD system, and referring to FIG. 6, it may be desirable for the MWD tool 14 to be able to measure fluid pressure in the annular space between the casing 12 and the wellbore wall (not shown in FIG. 6). In one example, the centralizer (middle centralizer 16 shown in FIG. 6) may include features to provide signal communication from a pressure sensor 32 disposed in the outer wall of the casing 12 to the MWD tool 14 when inserted into the centralizer 16. In the present example, the pressure sensor 32 may be disposed in the wall of the casing 12 so that it is sensitive to fluid pressure outside the casing 12. Electrical connection (for electrical pressure sensors) may be made through the wall of the casing 12 to the interior thereof using a pressure sealed electrical feed through 34. One such feedthrough is sold under the trademark KEMTITE, which is a trademark of Kemlon Products and Development, Pearland, Tex. Corresponding structures may be used for optical signal connection if the pressure sensor 32 is an optical pressure sensor. Electrical wiring inside the drill string may be conducted through a sealed tube 34A disposed proximate the bottom of the centralizer 16. A transformer coil 36 may be disposed on the bottom of the centralizer 16 so that it is in proximity to a corresponding transformer coil 38 in the MWD tool 14 when the MWD tool 14 is disposed in its ordinary position inside the casing 12 during use. Signals from the pressure sensor 32 may be electromagnetically communicated between the two transformer coils 36, 38 so that measurements of pressure may be transferred to the MWD tool 14 for storage therein and/or communication to the surface using, for example, the mud flow modulation telemetry device explained above with reference to FIG. 4.

Referring to FIG. 7, one example of a method for using the system described above will be explained. After the wellbore 1 has been drilled to a selected depth 12 by rotating the casing 12 and advancing the drill bit 22 through the subsurface, drilling operations may be temporarily stopped. The upper end of the casing 12 proximate the Earth's surface may then be opened to enable insertion therein a wireline, slickline or coiled tubing, shown in FIG. 7 generally by 52. The slickline, wireline or coiled tubing 52 may have at its lower end a retrieval tool 50 such as an overshot, configured to engage the fishing neck 28 on the MWD tool 14. After engagement, the slickline, wireline or coiled tubing 52 may be retrieved, thus removing the MWD tool 14 from inside the casing 12, leaving in place inside the casing 12 only the centralizers 16, 18, 24, and the drill bit 22 disposed at the bottom of the casing 12.

In FIG. 8, after removal of the MWD tool as explained with reference to FIG. 7, the annular space between the wall of the wellbore 1 and the outer wall of the casing 12 may be filled with cement 5 using techniques known in the art. After the cement 5 has hardened, the casing 12 may be opened for deeper drilling using a drill bit 56 having diameter selected to freely pass through the interior of the casing 12. The drill bit 56 may be moved longitudinally and rotated by a pipe string 54 which may be a suitably sized casing string or a string of drill pipe. One type of drill bit that may be advantageously used in some examples is a so-called "bi-center" bit that can drill a hole below the casing 12 having a diameter larger than the interior diameter of the casing 12. One such bi-center drill bit is disclosed in U.S. Pat. No. 6,269,893 issued to Beaton et al. The drill bit 56 may drill out the centralizers 16, 18, 24 and the cemented in place drill bit 22 to enable extending the depth of the wellbore 1.

Methods and systems according to the invention may enable use of MWD and/or LWD devices with casing drilling that are inexpensive to implement and avoid the need for expensive retrievably drill bits.

While the invention ahs been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A casing drilling system, comprising:

a casing having a drill bit at one end, the drill bit capable of drilling subsurface Earth formations and formed from a material susceptible to removal from the casing by at least one of drilling with another well drilling bit and chemical exposure, wherein the chemical exposure is substantially harmless to the casing;

at least one centralizer affixed to an interior of the casing, the at least one centralizer including a receptacle therein for engaging a measurement while drilling tool, the at least one centralizer formed from a material susceptible to removal from the casing by at least one of drilling with another well drilling bit and chemical exposure, wherein the chemical exposure is substantially harmless to the casing; and a measurement while drilling tool configured to move along the interior of the casing and to engage with the at least one centralizer, the measurement while drilling tool including at least one device to measure a drilling parameter or a formation parameter, the measurement while drilling tool including a latch at an upper end thereof for engagement with a retrieval tool moved through the interior of the casing, wherein the at least one centralizer comprises at least one passage for flow of drilling fluid between an exterior of the measurement while drilling tool and the interior of the casing.

2. The system of claim 1 wherein the at least one centralizer is formed from aluminum.

3. The system of claim 1 wherein the at least one centralizer is formed from fiber reinforced plastic.

4. The system of claim 1 wherein the at least one centralizer comprises a feature for engaging an exterior of the measurement while drilling tool such that a fixed rotary orientation of the measurement while drilling tool with respect to the casing is established.

5. The system of claim 1 wherein the drill bit is formed from aluminum.

6. The system of claim 1 further comprising at least one additional centralizer affixed to the interior of the casing at a longitudinally spaced apart position from the at least one centralizer, the at least one additional centralizer formed from a material susceptible to removal from the casing by at least one of drilling with another well drilling bit and chemical exposure, wherein the chemical exposure is substantially harmless to the casing.

7. The system of claim 6 wherein the measurement while drilling tool comprises a mud flow modulator disposed in a modulator housing, and wherein the at least one additional centralizer, and wherein the at least one additional centralizer is configured to sealingly engage an exterior of the modulator housing such that drilling fluid flow is diverted through the modulator housing.

8. The system of claim 1 wherein the at least one centralizer is threadedly engaged with the interior of the casing.

9. The system of claim 1 further comprising a pressure sensor disposed in a wall of the casing and exposed to an exterior thereof, the pressure sensor in signal communication with the measurement while drilling tool by a transformer coil associated with the at least one centralizer, the transformer coil positioned proximate a corresponding transformer coil disposed in the measurement while drilling tool.

10. A casing drilling system, comprising:

a casing having a drill bit at one end, the drill bit capable of drilling subsurface Earth formations and formed from a material susceptible to removal from the casing by at least one of drilling with another well drilling bit and chemical exposure, wherein the chemical exposure is substantially harmless to the casing;

at least one centralizer affixed to an interior of the casing, the at least one centralizer including a receptacle therein for engaging a measurement while drilling tool, the at least one centralizer formed from a material susceptible to removal from the casing by at least one of drilling with another well drilling bit and chemical exposure, wherein the chemical exposure is substantially harmless to the casing, and further wherein the at least one centralizer is threadedly engaged with the interior of the casing; and a measurement while drilling tool configured to move along the interior of the casing and to engage with the at least one centralizer, the measurement while drilling tool including at least one device to measure a drilling parameter or a formation parameter, the measurement while drilling tool including a latch at an upper end thereof for engagement with a retrieval tool moved through the interior of the casing; and an internally threaded insert affixed to an interior of the casing, the insert having threads thereon configured to engage mating threads on an exterior of the at least one centralizer.

11. The system of claim 10 wherein the insert is retained in the casing by interference fit.

12. The system of claim 10 wherein the insert is retained in the casing by welding.

13. A method for casing drilling, comprising:

rotating a casing having a drill bit at one end in a wellbore while urging the casing longitudinally therealong, the drill bit capable of drilling subsurface Earth formations and formed from a material susceptible to removal from the casing by at least one of drilling with another well drilling bit and chemical exposure, wherein the chemical exposure is substantially harmless to the casing, the casing including therein at least one centralizer affixed to an interior of the casing, the at least one centralizer including a receptacle therein for engaging a measurement while drilling tool, the at least one centralizer formed from a material susceptible to removal from the casing by at least one of drilling with another well drilling bit and chemical exposure, wherein the chemical exposure is substantially harmless to the casing, the casing including a measurement while drilling tool configured to move along the interior of the casing and to engage with the at least one centralizer, the measurement while drilling tool including at least one device to measure a drilling parameter or a formation parameter, the measurement while drilling tool including a latch at an upper end thereof for engagement with a retrieval tool moved through the interior of the casing;

at a selected depth, stopping the rotating and longitudinally urging, and inserting a retrieval tool inside the casing;

engaging the retrieval tool to the upper end of the measurement while drilling tool and removing the measurement while drilling tool from the casing;

at least one of drilling out and chemically removing the at least one centralizer and the drill bit from the casing; and during the rotating and urging the drill bit, modulating a flow of fluid inside the casing to communicate signals from the measurement while drilling tool to the surface.

14. The method of claim 13 further comprising placing cement in an annular space between the casing and the wellbore prior to removing the at least one centralizer.

15. The method of claim 13 wherein the engaging the retrieval tool and removing the measurement while drilling tool comprises at least one of extending a wireline, a slickline and a coiled tubing into the casing.

16. The method of claim 13 wherein the drilling out comprises rotating and longitudinally moving a drill out drill bit inside the casing, and further comprising extending the wellbore by continuing to rotate and longitudinally urge the drill out drill bit.

* * * * *